US005149362A

United States Patent [19]

Okutomi et al.

[11] Patent Number: 5,149,362

[45] Date of Patent: Sep. 22, 1992

[54] CONTACT FORMING MATERIAL FOR A VACUUM INTERRUPTER

[75] Inventors: Tsutomu Okutomi, Yokohama; Atsushi Yamamoto, Fuchu; Seishi Chiba, Yokohama; Tsuneyo Seki, Fuchu; Mikio Okawa, Tama; Mitsutaka Honma, Tokorozawa; Kiyofumi Otobe, Hachioji; Yoshinari Satoh, Tokyo; Tadaaki Sekiguchi, Yokohama, all of Japan

[73] Assignee: Kabushiki Kaisha Toshiba, Japan

[21] Appl. No.: 386,264

[22] Filed: Jul. 28, 1989

[30] Foreign Application Priority Data

Aug. 19, 1988 [JP] Japan ..... 63-205965

[51] Int. Cl.[5] ..... C22C 29/08

[52] U.S. Cl. ..... 75/240; 75/242; 75/247; 420/497; 420/503; 428/551; 419/18; 200/265

[58] Field of Search ..... 200/266, 265; 75/240, 75/242, 247; 420/497, 503; 428/551; 419/18

[56] References Cited

U.S. PATENT DOCUMENTS

| | | | |
|---|---|---|---|
| 3,807,965 | 4/1974 | Tazaki et al. | 29/182.1 |
| 3,859,087 | 1/1975 | Backstrom | 75/213 |
| 3,992,199 | 11/1976 | Neely | 75/200 |

FOREIGN PATENT DOCUMENTS

| | | |
|---|---|---|
| 0118844 | 9/1984 | European Pat. Off. . |
| 62-077439 | 9/1987 | Japan . |
| 63-096243 | 9/1988 | Japan . |
| 1346758 | 2/1974 | United Kingdom . |

OTHER PUBLICATIONS

Chemical Abstracts, vol. 85, No. 6, Aug. 9, 1976, p. 496, ref. No. 39953t.

*Primary Examiner*—Stephen J. Lechert, Jr.
*Assistant Examiner*—Ngoclan T. Mai

[57] ABSTRACT

An Ag-Cu-WC contact forming material for a vacuum interrupter comprising a highly conductive component comprising Ag and Cu and an arc-proof component comprising WC wherein the content of the highly conductive component is such that the total amount of Ag and Cu(Ag+Cu) is from 25% to 65% by weight and the percentage of Ag based on the total amount of Ag and Cu[Ag/(Ag+Cu)] is from 40% to 80% by weight; wherein the content of the arc-proof component is from 35% to 75% by weight; wherein the structure of the highly conductive component comprises a matrix and a discontinuous phase, the discontinuous phase having a thickness or width of no more than 5 micrometers and wherein said arc-proof component comprises a discontinuous grain having a grain size of no more than 1 micrometer.

9 Claims, 1 Drawing Sheet

CONTACT FORMING MATERIAL FOR A VACUUM INTERRUPTER

BACKGROUND OF THE INVENTION

This invention relates to a sintered alloy used in a contact forming material for a vacuum interrupter, a vacuum circuit breaker or a vacuum circuit interrupter, and, more particularly, to a contact forming material for a vacuum interrupter having an improved current chopping characteristic and high-frequency arc-extinguishing characteristic.

Contacts for a vacuum interrupter for carrying out current interruption in a high vacuum utilizing an arc diffusion property in a vacuum, are constituted of two opposing contacts, i.e., stationary and movable contacts. When the current of an inductive circuit such as a motor load is interrupted by means of the vacuum interrupter, an excessive abnormal surge voltage is generated and a load instrument tends to be broken.

The reasons why such an abnormal surge voltage is generated are attributable to phenomena such as chopping phenomenon generated when a small current is interrupted in a vacuum (a current interruption is forcedly carried out before the waveform of an alternating current reaches the natural zero point) and a high-frequency arc-extinguishing phenomenon.

The value Vs of the abnormal surge voltage due to the chopping phenomenon is expressed by a product of the surge impedance Zo of a circuit and the current chopping value Ic, i.e., $Vs=Zo.Ic$. Accordingly, in order to reduce the abnormal surge voltage Vs, the current chopping value Ic must be decreased.

In order to meet the requirements described above, there have been developed vacuum swtiches wherein contacts composed of tungsten carbide (WC)-silver (Ag) alloys are used (Japanese patent application No. 68447/1967 and U.S. Pat. No. 3,683,138). Such vacuum switches have been put to practical use.

The contacts composed of such Ag-WC alloys have the following advantages:

(1) the presence of WC facilitates electron emission;

(2) the evaporation of the contact forming material is accelerated by heating of the surface of electrodes due to collision of field emission electrons; and (3) the contacts exhibit a low chopping current characteristic which is excellent, e.g., for remaining an arc by decomposing a carbide of the contact forming material by the arc and forming a charged particle.

Another contact forming material exhibiting a low chopping current characteristic is a bismuth (Bi)-copper (Cu) alloy. Such a material has been put to practical use to form a vacuum interrupter (Japanese Patent Publication No. 14974/1960, U.S. Pat. No. 2,975,256, Japanese Patent Publication No. 12131/1966 and U.S. Pat. No. 3,246,979). Of these alloys, those containing 10% by weight (hereinafter referred to as wt. %) of Bi (Japanese Patent Publication No. 14974/1960) have suitable vapor pressure characteristics and therefore exhibit low chopping current characteristics. Those containing 0.5 wt. % of Bi (Japanese Patent Publication No. 12131/1966) segregate Bi in crystal boundaries and this therefore renders the alloy per se brittle. Thus, a low welding opening force is realized and the alloys have an excellent large current interruption property.

Another contact forming material exhibiting a low chopping current characteristic is an Ag-Cu-WC alloy wherein the ratio of Ag to Cu is approximately 7:3 (Japanese patent application No. 39851/1982). In this alloy, a ratio of Ag to Cu which has not been used in the prior art is selected and therefore it is said that stable chopping current characteristic is obtained.

Furthermore, Japanese patent application No. 216648/1985 suggests that the grain size of an arc-proofing material (e.g., the grain size of WC) of from 0.2 to 1 micrometer is effective for improving the low chopping current characteristic.

A low surge property is required for vacuum breakers, and therefore a low chopping current characteristic (low chopping characteristic) has been required in the prior art.

In recent years, vacuum interrupters have been increasingly applied to inductive circuits such as motors, and high surge impedance load. Accordingly, vacuum interrupters must combine an even more stable low chopping current characteristic and a satisfactory high-frequency arc-extinguishing characteristic (high-frequency current interruption capability). This is because it has turned out that surges due to multiple reignitions are undesirable for insulation of the load, as well as for surges due to current chopping.

Heretofore, there have been no contact forming materials which simultaneously satisfy these two characteristics.

That is, while a surge due to the current chopping described above (overvoltage) can be improved by reducing a current chopping value, a surge due to repeated high-frequency reignition is one wherein a recovery voltage value is increased by interrupting a high-frequency current which passes depending upon the circuit conditions when a dielectric breakdown is generated between electrodes after current chopping, and furthermore a recovery voltage value is increased by repeating a process in which a dielectric breakdown is generated between the electrodes, whereby an excessively large surge voltage is generated. In this case, a surge is generated in order to extinguish a high-frequency current, and the generated surge can be reduced by improving the high-frequency arc-extinguishing characteristic so that the surge voltage is reduced. Therefore, it is necessary to improve and stabilize the arc reestablishment characteristic of a high-frequency current discharge.

In the contacts composed of the WC-Ag alloys (Japanese patent application No. 68447/1967 and U.S. Pat. No. 3,683,138), the chopping current value per se is insufficient, and no regard is paid to the improvement of high-frequency arc-extinguishing characteristic.

In the 10 wt. % Bi-Cu alloys (Japanese Patent Publication No. 14974/1960 and U.S. Pat. No. 2,975,256) the amount of a metal vapor fed to the space between the electrodes is reduced as the number of make and break increases. The deterioration of low chopping current characteristic occurs and the deterioration of withstand voltage occurs depending upon the amount of an element having a high vapor pressure. Furthermore, the high-frequency arc-extinguishing characteristic is not entirely satisfactory.

In the 0.5 wt. % Bi-Cu alloy (Japanese Patent Publication No. 12131/1966 and U.S. Pat. No. 3,246,979), its low chopping current characteristic is insufficient.

In the Ag-Cu-WC alloys wherein the weight ratio of Ag to Cu is approximately 7:3 (Japanese patent application No. 39851/1982) and the alloys wherein the grain size of the arc-proofing material is from 0.2 to 1 micrometer (Japanese patent application No. 216648/1985), their high-frequency arc-extinguishing characteristic is not entirely satisfactory.

An object of the present invention is to provide a contact forming material which combines an excellent low chopping current characteristic and high-frequency arc-extinguishing characteristic and which meets the requirement for a vacuum breaker to be used under severe conditions.

SUMMARY OF THE INVENTION

We have now found that for Ag-Cu-WC contact forming materials, if the contents of Ag and Cu, their ratios and states are optimized and if the grain size of an arc-proof component WC is even more refined, then the object of the present invention is effectively achieved.

A contact forming material for a vacuum interrupter according to the present invention relates to an Ag-Cu-WC contact forming material for a vacuum interrupter comprising a highly conductive component consisting of Ag and Cu and an arc-proof component consisting of WC, wherein (i) the content of the highly conductive component has such a content whereby the total amount of Ag and Cu (Ag+Cu) is from 25 to 65 wt. %, the percentage of Ag based on the total amount of Ag, and Cu[Ag/-(Ag+Cu)] is from 40 to 80 wt. %;

(ii) the content of the arc proof component is from 35 to 75 wt. %; and (iii) the structure of the contact forming material comprises a matrix and a discontinuous phase of the highly conductive component, said discontinuous phase having a thickness or width of no more than 5 micrometers, and a discontinuous grain of the arc-proof component having a grain size of no more than 1 micrometer; and the discontinuous phase of the highly conductive component is finely and uniformly dispersed in the matrix at intervals of no more than 5 micrometers.

In a preferred embodiment of the present invention, the contact forming material can contain a first auxiliary component consisting of Co in an amount of no more than 1 wt. %.

In a preferred embodiment of the present invention, the contact forming material can further contain a second auxiliary component consisting of C in an amount of from 1 ppm to $10\times10^2$ ppm.

In one embodiment of the present invention, in the portions exhibiting such a state that the discontinuous phase of the highly conductive component having a thickness or width of no more than 5 micrometers, is finely and uniformly dispersed in the matrix at intervals of no more than 5 micrometers, the matrix and discontinuous phase of the highly conductive component are each (i) a Cu solid solution having Ag dissolved therein and an Ag solid solution having Cu dissolved therein, or (ii) an Ag solid solution having Cu dissolved therein and a Cu solid solution having Ag dissolved therein.

In one desirable embodiment of the present invention, the first auxiliary component Co has an average grain size of no more than 10 micrometers and the part or whole of Co can be substituted with Ni and/or Fe.

In another desirable embodiment of the present invention, the second auxiliary component C has an average grain size of no more than 1 micrometer and C is highly dispersed, as free carbon, in an interface between the discontinuous phase of the highly conductive component and the discontinuous grain of the arc-proof component.

In a desirable further embodiment of the present invention, as for the highly conductive component, the state in which the discontinuous phase of the highly conductive component having a thickness or width of no more than 5 micrometers is finely and uniformly dispersed in the matrix at intervals of no more than 5 micrometers, comprises at least 50% by area of the total amount of the highly conductive component.

DETAILED DESCRIPTION OF THE INVENTION

Figure 1:
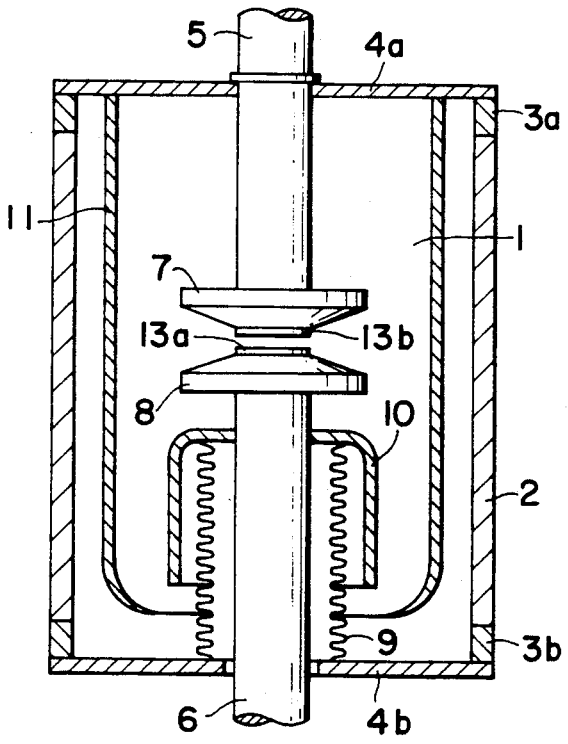
FIG. 1 is a sectional view of a vacuum interrupter to which a contact forming material for the vacuum interrupter according to the present invention is applied.

In order to improve the current chopping characteristic, it is extremely important to maintain the current chopping value per se at a lower value. In addition to the foregoing, it is also extremely important to reduce its scattering width. It is believed that the current chopping phenomenon described above be correlated with the amount of a vapor between contacts (vapor pressure and heat conduction as physical properties of a material), and electrons emitted from a contact forming material. According to our experiments, it has turned out that the former provides a larger contribution than the latter. Accordingly, we have found that if the feeding of a vapor is facilitated or if a contact is prepared from a material which is easily fed, the current chopping phenomenon can be alleviated. The Cu-Bi alloy described above has a low chopping value. However, such a Cu-Bi alloy has a fatal drawback in that Bi has a low melting point (271° C.) and therefore Bi melts during baking at a temperature of about 600° C. or during silver brazing at 800° C. carried out usually for vacuum interrupter. The molten Bi migrates and is agglomerated. As a result, the presence of Bi which should maintain current chopping characteristic becomes heterogeneous. Therefore, there is observed a phenomenon wherein the scattering width of the current chopping value is increased.

On the other hand, in the Ag and arc-proof material type alloy represented by Ag-WC, the following drawbacks can occur. While the resulting results are influenced by the amount of an Ag vapor at the boiling point of the arc-proof material (in this case, WC), the vapor pressure of Ag is remarkably lower than that of Bi in the Cu-Bi system described above and therefore this leads to thermal shortage, i.e., vapor shortage depending upon the member of a contact (Ag or the arc-proof material) to which the cathode spot is secured. Eventually, it has been confirmed that the scattering width of a current chopping value becomes apparent. It has been thought that it is difficult to prevent the drastical reduction in temperature at the surfaces of a contact at the end of current chopping, by using an alloy composed of a combination of Ag with an arc-proof material and to maintain an arc. It has been concluded that it is necessary to use auxiliary techniques in order to obtain higher performance. The Japanese patent application No. 39851/1982 described above discloses an improved process. This Japanese patent application suggests a technique wherein crystal grains are finely distributed by using an Ag-Cu alloy as a highly conductive component. According to this technique, the characteristics of the product are drastically stabilized. The situation to which an arc is principally secured is an arc-proof component or an Ag-Cu alloy. In any case, the current chopping phenomenon due to feed of an Ag-Cu vapor is alleviated (improved). However, some scattering can generate when the arc is secured to the arc-proof component.

On the other hand, the scattering width is improved by refining the arc-proof component. Accordingly, this suggests that the grain size of the arc-proof component plays an important role in the current chopping phenomenon and suggests that the grain size in the specific range should be used by considering the observation results showing remarkable scattering in the case of a contact forming material wherein segregation is observed (the size of the arc-proof component is from about 10 to about 20 times its initial grain size).

While its chopping current characteristic is improved by controlling the amounts of Ag and Cu and the grain size of WC to specific values as described in Japanese patent application No. 39851/1982, the technique described therein neither provides a lower chopping current characteristic, nor ensures a high-frequency arc-extinguishing characteristic. Particularly, the high-frequency arc-extinguishing characteristic is not improved by the technique described in Japanese patent application No. 39851/1982.

As described above, a surge due to multiple reignitions is one wherein a recovery voltage value is increased by interrupting a high-frequency current which passes depending upon the circuit conditions when dielectric breakdown is occured between electrodes after current chopping, and furthermore, a recovery voltage value is increased by repeating a process in which a dielectric breakdown is occured between the electrodes, whereby an excessive surge voltage is generated. In order to inhibit the excessive surge voltage, it is desirable to carry out the reestablishment of an arc until a load current of commercial frequency rises without extinguishing a high-frequency current discharge which passes during dielectric breakdown at a short gap between electrodes.

If the load current of the commercial frequency rises, a breaker is opened at a sufficient gap length between electrodes until a next current zero point is reached. Accordingly, current interruption is completed without dielectric breakdown occurring or repeating between the electrodes after the current zero point is reached. Therefore, the excessive surge voltage as described above is not generated.

If its high-frequency arc-extinguishing capability is reduced, a surge due to multiple reignitions is reduced even if the reestablishment of an arc is not reached. That is, the arc reestablishment characteristic of high-frequency current discharge at a short gap between electrodes must be improved.

In order to improve the arc reestablishment characteristic, in the present invention, first, Ag and Cu which are highly conductive components coexist. There are formed a matrix and a discontinuous phase (a layer-shaped structure or a rod-shaped structure) of (1) an Ag solid solution having Cu dissolved therein and (2) a Cu solid solution having Ag dissolved therein. The thickness or width of the discontinuous phase is no more than 5 micrometers and the discontinuous phase is finely and uniformly dispersed in the matrix at intervals of no more than 5 micrometers, whereby the highly conductive component is designed so that it is equal to or preferably less than the size of an arc spot diameter. As a result, the melting points of Ag and Cu components which principally perform a function of maintaining and sustaining an arc (hereinafter referred to as an arc maintaining material) are lowered and their vapor pressure is simultaneously increased.

Second, the average grain size of a WC grain is no more than 1 micrometer, preferably no more than 0.8 micrometer, and more preferably no more than 0.6 micrometer. This requirement aids in converting the dispersion of the arc maintenance material to an even more highly finely dispersed state. Even if only the contents of the arc maintenance materials (Ag and Cu) and their ratios are specified in the specific ranges, the desirable low chopping characteristic and desirable high-frequency arc-extinguishing characteristic cannot be obtained at the same time, as shown in Examples and Comparative Examples described hereinafter. According to the present invention, the structures of the arc maintaining materials (Ag and Cu) are highly refined and stabilized by combining the specific average grain size of a WC grain with specific values for the arc mainteining materials.

In general, the electric charge of an ion of a material having a high vapor pressure in a vacuum arc tends to lower. (See "Errosion and Ionization in the Cathode Spot Regions of Vacuum Arcs", edited by C. W. Kimblin, Journal of Applied Physics, Vol. 44, No. 7, p. 3074, 1973) That is, not only is the amount evaporated increased, but also, many ions having a low ion valence are present in an arc. Accordingly, when a current zero point is reached during a high-frequency current discharge process at a short gap between electrodes, the amount of a residual plasma present in the short gap between the electrodes according to the present invention (i.e., Ag and Cu are present so that they meet specific requirements) is larger than that of one case wherein the arc maintaining material is only Ag, or that of another case wherein the arc maintaining material is only Cu. This is preferable for simultaneous insurance of low chopping characteristic and high frequency arc-extinguishing characteristic which are the object of the present invention.

While the mass of a Cu ion is lighter than that of an Ag ion, the ion drift speed of the Cu ion at a current zero point is larger than that of the Ag ion (Cu: 930 m/sec.; and Ag: 630 m/sec.) (See the literature described above). Accordingly, the energy of Cu obtained when it collides with electrodes is larger than that of Ag. The electrodes are locally heated by ion impact and a synergism of such a heating and an effect attained by the amount of the residual plasma described above is obtained. A new cathode spot is liable to be formed at the surface of an electrode which newly becomes a cathode even if the current zero point is reached during a high-frequency small current discharge process. Thus, the arc reestablishment characteristic during the high-frequency small current discharge process is improved.

Since the present contact forming material has such an improved arc reestablishment characteristic, the load current of commercial frequency rises easily even if dielectric breakdown is generated at a short gap between electrodes. As a result, the 0.5 cycle arc time is extended. Because the current zero point is reached after the electrodes are sufficiently opened, the generation of an excessive surge voltage can be inhibited. Thus, the contents of Ag and Cu, their ratios and state are specified and the grain size of the arc-proof component WC is even more refined, whereby low chopping characteristic and high-frequency arc-extinguishing characteristic can be simultaneously improved.

The present invention will now be described with reference to attached drawings.

Figure 2:
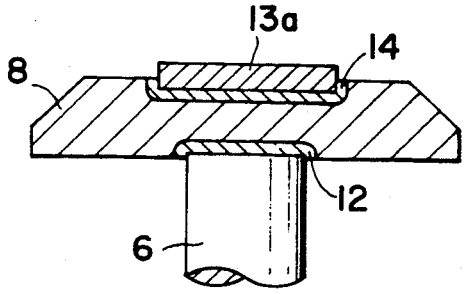
FIG. 2 is an enlarged sectional view of the electrode portion of the vacuum interrupter shown in FIG. 1.

FIG. 1 is a sectional view of a vacuum interrupter and FIG. 2 is an enlarged sectional view of the electrode portion of the vacuum interrupter.

In FIG. 1, reference numeral 1 shows an interruption chamber. This interruption chamber 1 is rendered vacuum-tight by means of a substantially tubular insulating vessel 2 of an insulating material and metallic caps 4*a* and 4*b* disposed at its two ends via sealing metal fittings 3*a* and 3*b*.

A pair of electrodes 7 and 8 fitted at the opposed ends of conductive rods 5 and 6 are disposed in the interruption chamber 1 described above. The upper electrode 7 is a stationary electrode, and the lower electrode 8 is a movable electrode. The electrode rod 6 of the movable electrode 8 is provided with bellows 9, thereby enabling axial movement of the electrode 8 while retaining the interruption chamber 1 vacuum-tight. The upper portion of the bellows 9 is provided with a metallic arc shield 10 to prevent the bellow 9 from becoming covered with arc and metal vapor. Reference numeral 11 designates a metallic arc shield disposed in the interruption chamber 1 so that the metallic arc shield covers the electrodes 7 and 8 described above. This prevents the insulating vessel 2 from becoming covered with the arc and metal vapor. As shown in FIG. 2 which is an enlarged view, the electrode 8 is fixed to the conductive rod 6 by means of a brazed portion 12, or pressure connected by means of a caulking. A contact 13*a* is secured to the electrode 8 by brazing as at 14. A contact 13*b* is secured to the electrode 7 by brazing.

One example of a process for producing the contact forming material will be described. Prior to production, the arc-proof component and the auxiliary components are classified on a necessary grain size basis. For example, the classification operation is carried out by using a sieving process in combination with a settling process to easily obtain a powder having a specific grain size. First, the specific amounts of WC having a specific grain size, Co and/or C and a portion of the specific amount of Ag having a specific grain size are provided, mixed and thereafter pressure molded to obtain a powder molded product.

The powder molded product is then calcined in a hydrogen atmosphere having a dew point of no more than −50° C. or under a vacuum of no more than $1.3\times10^{-1}$ Pa at a specific temperature, for example 1,150° C. (for one hour) to obtain a calcined body.

The specific amount of Ag-Cu having a specific ratio is then infiltrated into the remaining pores of the calcined body for one hour at a temperature of 1,150° C. to obtain an Ag-Cu-Co-WC alloy. While the infiltration is principally carried out in a vacuum, it can also be carried out in hydrogen.

In the case of Ag-Cu-WC containing no Co, the same process is carried out as described above. C is previously mixed in WC and/or Ag-Cu and a calcined body is obtained.

The control of the ratio Ag/(Ag+Cu) of the conductive components in the alloy was carried out as follows: For example, an ingot previously having a specific ratio Ag/(Ag+Cu) was subjected to vacuum melting at a temperature of 1,200° C. under a vacuum of $1.3\times10^{-2}$ Pa and the resulting product was cut and used as a stock for infiltration. Another process for controlling the ratio Ag/(Ag+Cu) of the conductive components can be carried out by previously mixing a portion of the specific amounts of Ag or Ag+Cu in WC, and thereafter infiltrating the remaining Ag or Ag+Cu in order to make a calcined body. Thus, a contact forming alloy having a desired composition can be obtained.

A method of evaluating data obtained in Examples of the present invention and the evaluation conditions are described below.

(1) Current Chopping Characteristic

Each contact was secured and evacuated to no more than $10^{-3}$ Pa to prepare an assembly-type vacuum interrupter. This vacuum interrupter was opened at an opening rate of 0.8 m/sec., and there was measured a chopping current obtained when a small inductive current was interrupted. The interrupting current was 20 amperes (an effective value) and the frequency was 50 Hz. The opening phase was randomly carried out and the chopping current obtained was measured there when current interruption was carried out 500 times with respect to the respective three contacts. Their average and maximum values are shown in Tables 1 through 6. The numerical values are relative values obtained when the average of the chopping current value of Example 2 is expressed as 1.0.

(2) Hiqh-Frequency Arc-extinquishing Characteristic

When the overvoltage is generated at the load side by current chopping during switching a small inductive current, the difference between the overvoltage and the voltage of a power source is applied across the electrodes of a vacuum interrupter. If the voltage of the electrodes exceeds the withstand voltage value of a contact gap, dielectric breakdown occurs to discharge, and a transient high-frequency current is passed through a contact. When this high-frequency current is interrupted, the contact is returned to the original stage and an overvoltage is developed. The overvoltage causes the discharge of the contact gap to occur. Such a repeating phenomenon that is well known as a multiple reignition phenomenon, then occurs. In the cases of breakers having a high-frequency arc-extinguishing capability such as vacuum circuit breakers, their large surge voltage is generated by multiple reignition under certain circuit conditions, and the insulation of a load instrument (a motor or a transformer) can be impaired. It is said that the smaller the high-frequency arc-extinguishing capability, the more difficult the reignition repetition. Thus, a generated surge becomes small.

In order to examine the high-frequency arc-extinguishing characteristic of each contact, a vacuum interrupter was manufactured by securing each contact and evacuating to no more than $10^{-3}$ Pa. A breaker was produced by incorporating the vacuum interrupter. A load current interruption test of a 6.6 kV, 150 kVA single-phase transformer was carried out by means of the breaker. The breaker and the transformer were connected by means of a 6.6 kV single-phase XLPE cable having a length of 100 meters (the cross-sectional area of a conductor being 200 square millmeter). The load current used was 10 amperes (an effective value), and the opening rate of the breaker used was 0.8 meter per second (on an average). The opening phase of the breaker was controlled and the current was interrupted at such a phase that multiple reignition was generated.

The transient high-frequency current flowing through a circuit during the multiple reignition process has a frequency which is determined by the inductance around the breaker and the floating capacitance at the power source and load sides. In this test, the frequency of the transient high-frequency current was about 100 kHz. The high-frequency arc-extinguishing capability was measured as follows. Twenty current interruption tests per each contact were carried out and the average of the high-frequency arc-extinguishing capability obtained when 1 ms elapsed after opening, was determined.

The values shown in Tables are relative values obtained when the high-frequency arc-extinguishing capability of Example 2 (percentage current reduction at the current zero obtained when the current, was interrupted under the conditions described above: di/dt [A/usec]) is expressed as 100%.

CONTACT UNDER TEST

The materials from which the contacts under test are produced and the corresponding characteristic data are shown in Tables 1 through 6.

As shown in Tables, the amount of Ag+Cu in an Ag-Cu-WC-Co alloy was varied in the range of from 14.3 wt. % to 82.2 wt. %, the ratio of Ag to Ag plus Cu (Ag/Ag+Cu) was varied in the range of from 0 to 100 wt. %, and the proportion occupied by a region of a state of Ag and Cu, i.e., such a state that a discontinuous phase of highly conductive components having a thickness or width of no more than 5 micrometers (a lamellar or rod-shaped structure) is finely and uniformly dispersed in a matrix at intervals of no more than 5 micrometers, was divided into 75-100% by area, 50% by area, 25% by area, and no more than 10% by area. These are obtained while adjusting a cooling rate in the process for cooling each contact, i.e., an average cooling rate by which the temperature is reduced by 100° C. within a temperature range between 1,000° C. or higher and 770° C. so that the % by area described above is obtained. For example, the foregoing can be obtained by solidifying while cooling at a rate of at least 0.6° C. per minute, preferably at a rate of at least 6° C. per minute. Cooling rates lower than 0.6° C. per minute are disadvantageous for the dispersion of Ag and Cu.

Furthermore, contacts composed of WC having a grain size of from 0.1 micrometer to 9 micrometers were evaluated. Contacts obtained by using Co as an auxiliary componment (Co=0.05-3.5 micrometers), contacts obtained without using Co (Co=zero) and contacts obtained by using Co having a grain size of from 0.1 to 44 micrometers were evaluated.

These conditions and the corresponding results are shown in Tables 1 through 6.

EXAMPLES 1 THROUGH 3 AND COMPARATIVE EXAMPLES 1 AND 2

A WC powder having an average grain size of 0.7 micrometer and a Co powder having an average grain size of 1.5 micrometers are provided. These are mixed at a specific ratio, and thereafter, molded while suitably selecting the molding pressure in the range of from zero to 8 metric tons per square centimeter so that the amount of the remaining void present after sintering is adjusted. In the cases wherein the amount of Ag+Cu in the alloys is large (Example 3: Ag+Cu=65 wt. %; and Comparative Example 2: Ag+Cu=82.2 wt. %), there is used a process wherein the molding pressure is particularly low, or another process wherein a portion of Ag+Cu is previously mixed with WC and Co to obtain a mixture and the mixture is molded. After molding the mixture, the following method is used. In Example 1 and Comparative Example 1, the mixture is sintered at a temperature of, for example, from 1,100° C. to 1,300° C. to obtain a WC-Co sintered body. In Examples 2 and 3 and Comparative Example 2, the mixture is sintered at a temperature of less than 1,100° C. to obtain a sintered body. Thus, Ag and Cu are infiltrated into the void of the sintered body having different void levels (if necessary, only Ag is infiltrated) to eventually obtain alloys wherein the amount of Ag+Cu in the Ag-Cu-WC-Co alloys is from 14 to 82 wt. % (Comparative Examples 1 and 2 and Examples 1 through 3). These contact stocks were processed into a specific shape, and chopping characteristic and high-frequency arc-extinguishing characteristic were evaluated under the conditions described above by the evaluation methods described above.

As described above, the chopping characteristic was evaluated by comparing its characteristic obtained when current interruption was carried out 500 times. As can be seen from Comparative Examples 1 and 2 and Examples 1 through 3 shown in Tables 1 and 2, the average of chopping values obtained by using the amount of Ag+Cu in the alloys is no more than 2 when the average of the chopping value of Example 2 (Ag+Cu 46.1 wt. %, and Ag/(Ag+Cu)=73.5%) was expressed as 1.0 (the increase in average of chopping values exhibiting deterioration of characteristic). When Ag+Cu=14.3 wt. % (Comparative Example 1) and Ag+Cu=82.2 (Comparative Example 2), the maximum is higher. In contrast, when Ag+Cu is from 25 to 65 wt. % (Examples 1 through 3), the maximum is less than 2.0 (their characteristic being good). In particular, it is observed that when large number of current interruption is carried out, the chopping characteristic of contacts having a small amount of Ag+Cu such as Comparative Example 1 (Ag+Cu=14.3 wt. %) is deteriorated after about 2,000 make and break.

On the other hand, high-frequency arc-extinguishing characteristic is evaluated. Characteristic of Example 2 is used as a standard 100 to examine a relative value. When the amount of Ag+Cu is from 25 to 65 wt. % (Examples 1 through 3), stable characteristic is obtained. When the amount of Ag+Cu is 14.3 wt. % (Comparative Example 1) and 82.2 wt. % (Comparative Example 2), the relative values described above tend to increase (their characteristics being deteriorated). It is observed that the relative value exceeds 200. Accordingly, it is preferred that the amount of Ag+Cu in the Ag-Cu-WC-Co alloy be in the range of from 25 to 65 wt. % from the standpoints of both chopping characteristic and high-frequency arc-extinguishing characteristic.

EXAMPLES 4 THROUGH 8 AND COMPARATIVE EXAMPLES 3 THROUGH 6

As described above, it has turned out that, even if the amount of Ag+Cu is in the preferred range, i.e., the range of from 25 to 65 wt. %, the chopping characteristic and high-frequency arc-extinguishing characteristic are deteriorated unless the ratio of Ag to Ag+Cu of the Ag-Cu-WC-Co alloy is appropriate. That is, when the value of Ag/(Ag+Cu) was from 40 to 80 wt. % (Examples 4 through 8), preferred choppingh characteristic (their relative value being no more than 2.0) and preferred high-frequency arc-extinguishing characteristic (their relative value being no more than 200) were obtained.

It is observed that, when the value of Ag/(Ag+Cu) is 96.8 wt. % and 100 wt. % (Comparative Examples 3 and 4), a high heat conduction property is observed. Furthermore, it is observed that, when the value of Ag/(Ag+Cu) is from 21.2 wt. % to zero (Comparative Examples 5 and 6), their chopping characteristic is reduced principally due to shortage of the amount of Ag which is a vapor source.

In Examples 1 through 8 and Comparative Examples 1 through 6, both chopping characteristic and high-frequency arc-extinguishing characteristic exhibit the same tendency with respect to the amount of Ag+Cu and the ratio of Ag/(Ag+Cu).

EXAMPLES 9 AND 10 AND COMPARATIVE EXAMPLES 7 AND 8

Contacts were prepared in a conventional method wherein the proportion occupied by the region of a state of an Ag-Cu portion in an Ag-Cu-WC-Co alloy, i.e., such a state that a discontinuous phase of highly conductive components having a thickness or width of no more than 5 micrometers (a layer-shaped or rod-shaped structure) is finely and uniformly dispersed in a matrix at intervals of no more than 5 micrometers had specific % by area, the amount of Ag+Cu was about 4 5 wt. % and Ag/(Ag+Cu) was about 70 wt. %. The contacts were obtained by infiltrating, cooling at a specific cooling rate and subjecting them to heat treatment (reheating retention) for about one hour at a temperature of 800° C. to 1,000° C. to obtain contacts having various area proportions (%). When the area proportion is at least 50% (Examples 9 and 10), the contacts have a low chopping characteristic and exhibit a good high-frequency arc-extinguishing characteristic. In contrast, when the area proportion is smaller (Comparative Examples 7 and 8), it is observed that the chopping characteristic deteriorates and in particular the maximum is greatly increased (deteriorated) and their high-frequency arc-extinguishing characteristic is also increased (deteriorated). Accordingly, it is preferred that the above area, proportion of the state of Ag and Cu be at least 50% in the Ag+Cu phase.

EXAMPLES 11 THROUGH 13 AND COMPARATIVE EXAMPLE 9

Co in an Ag-Cu-WC alloy is used as an auxiliary component which inhibits segregation of WC or generation of pores during the alloy production process. Even if Co is zero, an Ag-Cu-WC alloy carefully prepared so that segregation of WC or generation of pores is controlled, has a good chopping characteristic and a good high-frequency arc-extinguishing characteristic (Example 13).

Industrially, in the case of the presence of Co up to a specific value (the amount of Co being 1 wt. %; Example 11), the average and maximum of the chopping value are in the low range (Examples 11 and 12). When the amount of Co is zero, the average and maximum are low and their relative values are no more than 2.0. Thus, the relative values are within the practical range. However, when the maximum obtained when the amount of Co is zero, is compared the maximum obtained when the amount of Co is 1 wt. % or 0.05 wt. % (Examples 11 and 12), there is a difference therebetween. This tends to exhibit scattering.

When the amount of Co is in the range of from 3.5 wt. % (Comparative Example 9) to zero, the relative value of high-frequency arc-extinguishing characteristic is no more than 200. Thus, the presence of Co poses no problems with respect to high-frequency arc-extinguishing characteristic. However, when the amount of Co is 3.5 wt. %, the maximum of chopping characteristic exhibits a high value (2.3 times). Thus, the presence of the larger amount of Co is excluded. It is preferred that Co in the Ag-Cu-WC-Co alloy be present in an amount of no more than 1 wt. % including zero from the standpoints of chopping characteristic and high-frequency arc-extinguishing characteristic.

EXAMPLES 14 THROUGH 16 AND COMPARATIVE EXAMPLE 10

In all of Examples 1 through 12 and Comparative Examples 1 through 9, the grain size of Co used was 1.5 micrometer. The grain size of Co particularly affects the maximum of the chopping characteristic. That is, when the grain size of Co is in the range of from 0.1 to 44 micrometers (Examples 14 through 16 and Comparative Example 10), the relative value of the chopping characteristic is no more than 200 and such a grain size poses no problems. When the grain size of Co is 44 micrometers (Comparative Example 10), the average of the chopping characteristic is in the preferred range. However, its maximum is deteriorated.

As can be seen from the foregoing, the grain size of Co in the Ag-Cu-WC-Co alloy having no more than 1 wt. % of Co (Examples 11 through 13) is no more than 10 micrometers (Examples 14 through 16).

EXAMPLES 17 THROUGH 19 AND COMPARATIVE EXAMPLE 11

The amount of free carbon in an Ag-Cu-WC-Co alloy is beneficial for improvement of chopping characteristic. Particularly, in the case of $57\times10^2$ ppm of free carbon (Comparative Example 11), the average and maximum of a chopping value are excellent. However, the withstand voltage value is about ½ that of Example 2 as a standard. The alloy containing $57\times10^2$ ppm of free carbon is undesirable for a contact forming material, and excluded from the present invention.

When the amount of free carbon is from $10\times10^2$ ppm to $0.01\times10^2$ ppm (Examples 17 through 19), withstand voltage characteristic is not deteriorated, the relative value of a chopping value is low and high-frequency arc-extinguishing characteristic is also stable. Accordingly, the amount of free carbon up to $10\times10^2$ ppm is acceptable.

When the amount of free carbon is $0.01\times10^2$ ppm (Example 19), the chopping value is larger than that of the cases wherein the amount of free carbon is from $10\times10^2$ to $0.3\times10^2$ ppm. However, the relative value compared with that of Example 2 is no more than 2.0.

EXAMPLES 20 AND 21 AND COMPARATIVE EXAMPLE 12

Even if the amount of free carbon in an Ag-Cu-WC-Co alloy is in the preferred range, for example, $1\times10^2$ ppm, it is observed that the maximum of the chopping value is increased as compared with 1 ppm-0.1 micrometer when the grain size of C is 23 micrometers (Comparative Example 12). In this case, the relative value is no more than twice that of Example 2 and there is no problem from the standpoint of chopping characteristic. However, when the grain size of free carbon is 23 micrometers, the withstand voltage value is no more than ⅔ that of Example 2. The alloy containing C having a grain size of 23 micrometers is undesirable for a contact forming material, and is excluded from the present invention. On the other hand, when the grain size is in the range of from 1 ppm to 0.1 micrometer, an extremely stable chopping characteristic and high-frequency arc-extinguishing characteristic are obtained.

EXAMPLES 22 THROUGH 24 AND COMPARATIVE EXAMPLES 13 AND 14

The grain size of WC is correlated to the chopping characteristic and high-frequency arc-extinguishing characteristic of an Ag-Cu-WC-Co alloy. When the grain size of WC is 3.5 micrometers (Comparative Example 14), both the average and maximum of the relative values of chopping characteristic are no more than 2.0 and thus there is no problem. However, it is observed that its high-frequency arc-extinguishing characteristic is deteriorated (the relative value being more than 200). When the grain size of WC is 9 micrometers (Comparative Example 13), the maximum of the chopping value (relative value) exceeds 2.0 and scattering becomes large.

On the other hand, when the grain size of WC is no more than 1.0 micrometer (Examples 22 through 24), the average and maximum of the chopping values are remarkably stable and their high-frequency arc-extinguishing characteristic exhibits extremely preferred relative values. Accordingly, it is preferred that the grain size of WC be in the range of from 1 ppm to 0.1 micrometer (Examples 22 through 24). When the grain size is less than 0.1 micrometer, the handling is not industrially easy, sintering proceeds excessively, and the characteristics of a stock are unstable.

While Co is principally described as the auxiliary component, similar results were obtained when an Ni-Co powder (Example 25) and an Ni-Fe powder (Example 26) were used.

TABLE 1

| | Contact Forming Material under Test | | | | | | | | | | | |
|---|---|---|---|---|---|---|---|---|---|---|---|---|
| | Highly Conductive Component | | | | | | First Auxiliary Component | | Second Auxiliary Component (Free Carbon) | | Arc-proof Component (WC) | |
| | Ag wt % | Cu wt % | [Ag + Cu] wt % | Ag / (Ag + Cu) × 100 wt % | Proportion wherein the sizes of Ag and Cu are no more than 5 μm and their intervals are no more than 5 μm | Material | Amount wt % | Grain Size μm | Amount × $10^2$ ppm | Grain Size μm | Amount wt % | Grain Size μm |
| Comp. Exam. 1 | 11.0 | 3.3 | 14.3 | 77.0 | 75-100 | Co | 0.2 | 1.5 | 1 | 0.5 | Bal. | 0.7 |
| Exam. 1 | 17.8 | 7.2 | 25.0 | 71.2 | 75-100 | Co | 0.2 | 1.5 | 1 | 0.5 | Bal. | 0.7 |
| Exam. 2 | 33.9 | 12.2 | 46.1 | 73.5 | 75-100 | Co | 0.2 | 1.5 | 1 | 0.5 | Bal. | 0.7 |
| Exam. 3 | 47.1 | 17.9 | 65.0 | 72.4 | 75-100 | Co | 0.2 | 1.5 | 1 | 0.5 | Bal. | 0.7 |
| Comp. Exam. 2 | 62.3 | 19.9 | 82.2 | 75.8 | 75-100 | Co | 0.2 | 1.5 | 1 | 0.5 | Bal. | 0.7 |
| Comp. Exam. 3 | 49.2 | 0 | 49.2 | 100 | zero | Co | 0.2 | 1.5 | 1 | 0.5 | Bal. | 0.7 |
| Comp. Exam. 4 | 45.5 | 1.5 | 47.0 | 96.8 | 0-10 | Co | 0.2 | 1.5 | 1 | 0.5 | Bal. | 0.7 |
| Exam. 4 | 37.0 | 9.2 | 46.2 | 80.0 | 50-75 | Co | 0.2 | 1.5 | 1 | 0.5 | Bal. | 0.7 |
| Exam. 5 | 47.5 | 14.9 | 62.4 | 76.2 | 75-100 | Co | 0.2 | 1.5 | 1 | 0.5 | Bal. | 0.7 |
| Exam. 6 | 24.1 | 21.8 | 45.9 | 52.5 | 50-75 | Co | 0.2 | 1.5 | 1 | 0.5 | Bal. | 0.7 |
| Exam. 7 | 29.7 | 35.1 | 64.9 | 45.8 | 50-75 | Co | 0.2 | 1.5 | 1 | 0.5 | Bal. | 0.7 |
| Exam. 8 | 18.8 | 28.1 | 46.9 | 40.1 | 50-75 | Co | 0.2 | 1.5 | 1 | 0.5 | Bal. | 0.7 |
| Comp. Exam. 5 | 9.9 | 36.7 | 46.6 | 21.2 | 25-10 | Co | 0.2 | 1.5 | 1 | 0.5 | Bal. | 0.7 |
| Comp. Exam. 6 | zero | 42.3 | 42.3 | zero | zero | Co | 0.2 | 1.5 | 1 | 0.5 | Bal. | 0.7 |

TABLE 2

| | Evaluation Result | | | |
|---|---|---|---|---|
| | Chopping Current Characteristic Relative Value obtained when the Average Value of Example 2 is expressed as 1.00 (Number of contacts: 3) | | High-frequency Arc-extinguishing Characteristic Relative Value obtained when the Average Value of Example 2 is expressed as 100 (Number of Contacts: 3) | Remark |
| | Average | Maximum | | |
| Comp. Exam. 1 | 1.3 | 2.0 | 220 | Welding Generation; Current carrying capacity shortage; Chopping Value tends to increase after about 2,000 make and break (Characteristic Deterioration) |
| Exam. 1 | 1.2 | 1.6 | 130 | |
| Exam. 2 | (1.0) | 1.2 | 100 | |
| Exam. 3 | 1.3 | 1.7 | 120 | |
| Comp. Exam. 2 | 1.5 | 3.1 | 210 | |
| Comp. Exam. 3 | 1.25 | 2.2 | 290 | |
| Comp. | 1.2 | 1.9 | 240 | |

TABLE 2-continued

| | Evaluation Result | | | |
|---|---|---|---|---|
| | Chopping Current Characteristic Relative Value obtained when the Average Value of Example 2 is expressed as 1.00 (Number of contacts: 3) | | High-frequency Arc-extinguishing Characteristic Relative Value obtained when the Average Value of Example 2 is expressed as 100 (Number of Contacts: 3) | Remark |
| | Average | Maximum | | |
| Exam. 4 | | | | |
| Exam. 4 | 1.2 | 1.7 | 140 | |
| Exam. 5 | 1.3 | 1.8 | 160 | |
| Exam. 6 | 1.1 | 1.6 | 130 | |
| Exam. 7 | 1.5 | 1.9 | 160 | |
| Exam. 8 | 1.4 | 2.0 | 140 | |
| Comp. Exam. 5 | 2.1 | 3.5 | 210 | |
| Comp. Exam. 6 | 3.0 | 4.6 | 380 | |

TABLE 3

| | Contact Forming Material under Test | | | | | | | | | | | |
|---|---|---|---|---|---|---|---|---|---|---|---|---|
| | Highly Conductive Component | | | | | | | | | | | |
| | Ag wt % | Cu wt % | [Ag + Cu] wt % | $\frac{Ag}{Ag + Cu} \times 100$ wt % | Proportion wherein the sizes of Ag and Cu are no more than 5 μm and their intervals are no more than 5 μm | Material | First Auxiliary Component Amount wt % | First Auxiliary Component Grain Size μm | Second Auxiliary Component (Free Carbon) Amount $\times 10^2$ ppm | Second Auxiliary Component (Free Carbon) Grain Size μm | Arc-proof Component (WC) Amount wt % | Arc-proof Component (WC) Grain Size μm |
| Exam. 9 | 32.0 | 13.3 | 45.3 | 70.6 | 50–75 | Co | 0.2 | 1.5 | 1 | 0.5 | Bal. | 0.7 |
| Exam. 10 | 31.7 | 12.1 | 43.8 | 72.3 | 50 | Co | 0.2 | 1.5 | 1 | 0.5 | Bal. | 0.7 |
| Comp. Exam. 7 | 34.4 | 12.0 | 46.4 | 74.2 | 25 | Co | 0.2 | 1.5 | 1 | 0.5 | Bal. | 0.7 |
| Comp. Exam. 8 | 32.9 | 11.8 | 44.7 | 73.6 | 10–0 | Co | 0.2 | 1.5 | 1 | 0.5 | Bal. | 0.7 |
| Comp. Exam. 9 | 31.4 | 13.0 | 44.4 | 70.7 | 75–100 | Co | 3.5 | 1.5 | 1 | 0.5 | Bal. | 0.7 |
| Exam. 11 | 29.5 | 11.3 | 40.8 | 71.8 | 75–100 | Co | 1.0 | 1.5 | 1 | 0.5 | Bal. | 0.7 |
| Exam. 12 | 32.8 | 14.4 | 47.2 | 69.5 | 75–100 | Co | 0.05 | 1.5 | 1 | 0.5 | Bal. | 0.7 |
| Exam. 13 | 32.9 | 12.7 | 45.6 | 72.1 | 75–100 | Co | zero | 1.5 | 1 | 0.5 | Bal. | 0.7 |
| Exam. 14 | 39.9 | 13.1 | 48.0 | 72.7 | 75–100 | Co | 0.2 | 0.1 | 1 | 0.5 | Bal. | 0.7 |
| Exam. 15 | 32.9 | 11.4 | 44.2 | 74.4 | 75–100 | Co | 0.2 | 5 | 1 | 0.5 | Bal. | 0.7 |
| Exam. 16 | 34.0 | 12.5 | 46.5 | 73.1 | 75–100 | Co | 0.2 | 10 | 1 | 0.5 | Bal. | 0.7 |
| Comp. Exam. 10 | 31.3 | 10.6 | 41.9 | 74.7 | 75–100 | Co | 0.2 | 44 | 1 | 0.5 | Bal. | 0.7 |

TABLE 4

| | Evaluation Result | | | |
|---|---|---|---|---|
| | Chopping Current Characteristic Relative Value obtained when the Average Value of Example 2 is expressed as 1.00 (Number of contacts: 3) | | High-frequency Arc-extinguishing Characteristic Relative Value obtained when the Average Value of Example 2 is expressed as 100 (Number of Contacts: 3) | Remark |
| | Average | Maximum | | |
| Exam. 9 | 1.2 | 1.6 | 110 | |
| Exam. 10 | 1.3 | 1.9 | 130 | |
| Comp. Exam. 7 | 1.6 | 2.7 | 240 | |
| Comp. Exam. 8 | 2.1 | 3.8 | 340 | |
| Comp. Exam. 9 | 1.4 | 2.3 | 200 | |
| Exam. 11 | 1.25 | 1.3 | 110 | |
| Exam. 12 | 1.0 | 1.25 | 120 | |
| Exam. 13 | 1.0 | 1.8 | 150 | |
| Exam. 14 | 1.0 | 1.3 | 90 | |
| Exam. 15 | 1.2 | 1.5 | 130 | |
| Exam. 16 | 1.5 | 2.0 | 170 | |
| Comp. Exam. 10 | 1.7 | 2.6 | 200 | Highly uniform Dispersion of Ag/Cu is inhibited |

TABLE 5

| | Contact Forming Material under Test | | | | | | | | | | | |
|---|---|---|---|---|---|---|---|---|---|---|---|---|
| | Highly Conductive Component | | | | | | First Auxiliary Component | | Second Auxiliary Component (Free Carbon) | | Arc-proof Component (WC) | |
| | Ag wt % | Cu wt % | [Ag + Cu] wt % | Ag / (Ag + Cu) × 100 wt % | Proportion wherein the sizes of Ag and Cu are no more than 5 μm and their intervals are no more than 5 μm | Material | Amount wt % | Grain Size μm | Amount × $10^2$ ppm | Grain Size μm | Amount wt % | Grain Size μm |
| Comp. Exam. 11 | 33.4 | 13.3 | 46.7 | 71.5 | 75-100 | Co | 0.2 | 1.5 | 57 | 0.5 | Bal. | 0.7 |
| Exam. 17 | 33.6 | 11.5 | 45.1 | 71.2 | 75-100 | Co | 0.2 | 1.5 | 10 | 0.5 | Bal. | 0.7 |
| Exam. 18 | 34.0 | 12.3 | 46.3 | 73.4 | 75-100 | Co | 0.2 | 1.5 | 0.3 | 0.5 | Bal. | 0.7 |
| Exam. 19 | 35.8 | 9.6 | 45.4 | 78.9 | 75-100 | Co | 0.2 | 1.5 | 0.01 | 0.5 | Bal. | 0.7 |
| Comp. Exam. 12 | 35.0 | 10.9 | 45.9 | 76.2 | 75-100 | Co | 0.2 | 1.5 | 1 | 23 | Bal. | 0.7 |
| Exam. 20 | 30.2 | 10.4 | 40.6 | 74.5 | 75-100 | Co | 0.2 | 1.5 | 1 | 1.0 | Bal. | 0.7 |
| Exam. 21 | 31.3 | 11.4 | 42.7 | 73.3 | 75-100 | Co | 0.2 | 1.5 | 1 | 0.1 | Bal. | 0.7 |
| Comp. Exam. 13 | 31.3 | 11.5 | 42.6 | 73.1 | 75-100 | Co | 0.2 | 1.5 | 1 | 0.5 | Bal. | 9 |
| Comp. Exam. 14 | 29.6 | 9.8 | 39.4 | 75.1 | 75-100 | Co | 0.2 | 1.5 | 1 | 0.5 | Bal. | 3.5 |
| Exam. 22 | 33.4 | 11.4 | 44.8 | 74.6 | 75-100 | Co | 0.2 | 1.5 | 1 | 0.5 | Bal. | 1.0 |
| Exam. 23 | 35.6 | 11.6 | 47.2 | 75.4 | 75-100 | Co | 0.2 | 1.5 | 1 | 0.5 | Bal. | 0.3 |
| Exam. 24 | 31.3 | 12.5 | 43.8 | 71.5 | 75-100 | Co | 0.2 | 1.5 | 1 | 0.5 | Bal. | 0.1 |
| Exam. 25 | 29.7 | 35.1 | 64.9 | 45.8 | 50-75 | Ni-50Co | 0.2 | 3 | 1 | 0.5 | Bal. | 0.7 |
| Exam. 26 | 48.7 | 13.7 | 62.4 | 78.0 | 50-75 | Ni-42Fe | 0.2 | 3 | 1 | 0.5 | Bal. | 0.7 |

TABLE 6

| | Evaluation Result | | | |
|---|---|---|---|---|
| | Chopping Current Characteristic Relative Value obtained when the Average Value of Example 2 is expressed as 1.00 (Number of contacts: 3) | | High-frequency Arc-extinguishing Characteristic Relative Value obtained when the Average Value of Example 2 is expressed as 100 (Number of Contacts: 3) | Remark |
| | Average | Maximum | | |
| Comp. Exam. 11 | 0.7 | 1.0 | No data as for the reduction of voltage withstanding charateristic (½ of Example 2) | |
| Exam. 17 | 1.0 | 1.2 | 90 | |
| Exam. 18 | 1.0 | 1.3 | 100 | |
| Exam. 19 | 1.1 | 1.8 | 110 | |
| Comp. Exam. 12 | 1.1 | 1.6 | No data as for the reduction of voltage withstanding characteristic (⅔ of Example 2) | |
| Exam. 20 | 1.1 | 1.3 | 100 | |
| Exam. 21 | 1.0 | 1.3 | 110 | |
| Comp. Exam. 13 | 1.5 | 2.6 | 330 | Remarkable scattering of chopping values |
| Comp. Exam. 14 | 1.3 | 1.8 | 230 | |
| Exam. 22 | 1.1 | 1.3 | 130 | |
| Exam. 23 | 0.8 | 1.1 | 90 | |
| Exam. 24 | 0.7 | 1.0 | 80 | |
| Exam. 25 | 1.5 | 1.9 | 160 | |
| Exam. 26 | 1.6 | 2.0 | 150 | |

As can be seen from the Examples described above, by controlling the total amount of highly conductive materials consisting of Ag and Cu(Ag+Cu) and the ratio of Ag to Ag+Cu[Ag/(Ag+Cu)] to specific values, by using the average grain size of WC of no more than 1 micrometer and by highly and uniformly distributing Ag and Cu, current chopping characteristic can be maintained at a low level, scattering can be reduced and the high-frequency arc-extinguishing characteristic can be simultaneously maintained at a sufficiently low level.

As stated hereinbefore, according to the present invention, the following advantages and effects are achieved. That is, the current chopping characteristic can be maintained at a low level and scattering can be reduced.

Furthermore, the high-frequency arc-extinguishing characteristic can be simultaneously maintained at a low level. Accordingly, when the contact forming material of the present invention is used, a vacuum interrupter having good current chopping characteristic and current interruption characteristic can be obtained, and a contact forming alloy for a vacuum interrupter having even greater stability of the current chopping characteristic can be provided.

We claim:

1. An Ag-Cu-WC contact forming material for a vacuum interrupter comprising a highly conductive component comprising Ag and Cu and an arc-proof component consisting essentially of WC wherein the content of said highly conductive component is such that the total amount of Ag and Cu(Ag+Cu) is from 25% to 65% by weight and the percentage of Ag based on the total amount of Ag and Cu[Ag/(Ag+Cu)] is from 40% to 80% by weight; wherein the content of said arc-proof component is from 35% to 75% by weight; wherein the total amount of Cu is at least about 5% by weight; wherein the structure of said highly conductive component comprises a matrix and a discontinuous phase, said discontinuous phase having a thickness or width of no more than 5 micrometers and being finely and uniformly dispersed in said matrix at an interval of no more than 5 micrometers; and wherein said arc-proof component comprises a discontinuous grain of having a grain size of no more than 1 micrometer.

2. The contact forming material for the vacuum interrupter according to claim 1 which contains a first auxiliary component comprising of Co in an amount of no more than 1% by weight.

3. The contact forming material for the vacuum interrupter according to claim 1 which contains a second auxiliary component consisting of C in an amount of from 1 ppm to $10\times10^2$ ppm.

4. The contact forming material for the vacuum interrupter according to claim 1 wherein, in the portions exhibiting such a state that the discontinuous phase of the highly conductive component having a thickness or width of no more than 5 micrometers is finely and uniformly dispersed in the matrix at intervals of no more than 5 micrometers, the matrix comprises an Ag solid solution having Cu dissolved therein and the discontinuous phase comprises a Cu solid solution having Ag dissolved therein.

5. The contact forming material for the vacuum interrupter according to claim 1 wherein the first auxiliary component Co has an average grain size of no more than 10 micrometers and the part or whole of Co is substituted with Ni and/or Fe.

6. The contact forming material for the vacuum interrupter according to claim 1 wherein the second auxiliary component C has an average grain size of no more than 1 micrometer and C is highly dispersed, as free carbon, in an interface between said discontinuous phase of the highly conductive component and said discontinuous grain of the arc-proof component.

7. The contact forming material for the vacuum interrupter according to claim 1 wherein, in the structure of the contact forming material, the state in which the discontinuous phase of the highly conductive component having a thickness or width of no more than 5 micrometers is finely and uniformly dispersed in the matrix at intervals of no more than 5 micrometers comprises at least 50% by area of the total amount of the highly conductive component.

8. The contact forming material for the vacuum interrupter according to claim 1 wherein, in the portions exhibiting such a state that the discontinuous phase of the highly conductive component having a thickness or width of no more than 5 micrometers is finely and uniformly dispersed in the matrix at intervals of no more than 5 micrometers, the matrix comprises a Cu solid solution having Ag dissolved therein and the discontinuous phase comprises an Ag solid solution having Cu dissolved therein.

9. The contact forming material for the vacuum interrupter according to claim 1, wherein the arc-proof component is substantially free of Mo, Ti and Ta.

* * * * *